US005400912A

United States Patent [19]

Brown et al.

[11] Patent Number: 5,400,912

[45] Date of Patent: Mar. 28, 1995

[54] CLOSURE WITH CONCEALED HINGE

[75] Inventors: John J. Brown, Park Ridge; Michael Jacobs, McHenry, both of Ill.

[73] Assignee: Courtaulds Packaging Inc., Arlington Heights, Ill.

[21] Appl. No.: 60,093

[22] Filed: May 10, 1993

[51] Int. Cl.[6] ..... B65D 41/32

[52] U.S. Cl. ..... 215/238; 215/237; 220/339; 222/517; 222/556

[58] Field of Search ..... 222/498, 556, 541, 517, 222/570; 215/237, 238, 253, 256; 220/339

[56] References Cited

U.S. PATENT DOCUMENTS

| | | | |
|---|---|---|---|
| 4,782,985 | 11/1988 | Kinsley | 222/556 |
| 4,787,525 | 11/1988 | Joyce | 215/237 |
| 4,815,616 | 3/1989 | Silvenis | 222/517 |
| 4,911,324 | 3/1990 | Dubach | 222/556 |
| 5,083,671 | 1/1992 | Hayes | 215/253 |
| 5,211,301 | 5/1993 | Groya et al. | 215/237 |

FOREIGN PATENT DOCUMENTS

| | | | |
|---|---|---|---|
| 2749946 | 5/1978 | Germany | 222/517 |

*Primary Examiner*—S. Castellano
*Attorney, Agent, or Firm*—Baker & McKenzie

[57] ABSTRACT

A closure especially adapted for use with a dispenser spout, said closure having a concealed hinge arranged to permit the lid to be opened 180° away from its associated base to provide maximum access to a container to which the closure is assembled, the closure, consisting of a closure base and a lid, being capable of being molded in a single mold cavity.

16 Claims, 3 Drawing Sheets

10
11
12
13
16
17
18
19
20
21
22
23
24
26
27
28
29
32
33
34
35
36
37
38
39
40
41
42
43
47
55
56
61
69
70
71

CLOSURE WITH CONCEALED HINGE

This invention relates generally to a closure with a concealed hinge and specifically to a dispensing type closure adapted for use on a container, such as a tube, which includes a dispensing spout, the closure being so constructed as to be capable of being molded in a closed position and to be opened 180° to thereby provide maximum access to its associated container.

BACKGROUND OF THE INVENTION

All, or at least the very great majority, of current dispensing closures are molded in the open position or in two or more pieces. Closures molded open must be closed prior to capping. This extra step can be accomplished through post-mold closing equipment, or in-mold closing equipment. Either step adds cost to the process by requiring extra equipment. In addition, in-mold closing requires a longer molding cycle time and therefore a higher piece price cost.

Closures molded in the open position require twice as much tool space as closures molded in the closed position. Therefore, for a given tool size, a mold can contain twice as many cavities of molded closed closures, compared to molded open closures. This reduces the tool cost per cavity.

In addition, most molded open dispensing closures when capped onto an associated container and which require a tamper resistancy feature so as to protect against unintentional opening, use shrink wrap or a separate box to achieve this additional feature. The shrink wrap or a separate box increases the cost of manufacture of the final package in that an extra operation, separate and distinct from the molding operation in which the closure is formed, is required. And, of course, the cost of acquiring and providing equipment for a separate raw material is also required. Included in the cost of using a shrink wrap or separate box is the additional machine time necessary to apply a wrap or enclose the component within a box.

Most, if not all, conventional dispensing closures with living hinges have non-uniform peripheries due to hinge protrusions. As a consequence, the protruding hinge tends to cause interference during the assembly and handling phases of production. When the closures are fed to the capping equipment, for example, preparatory to being secured to a tube, the peripherally outwardly extending protrusions can be the cause of jam-ups in the closure feeding mechanism and consequent line down time while the jammed closures are freed and the feed line restarted. In addition, closures with protrusions are often not well adapted for inverted packaging and can be of concern with respect to consumer handling safety.

In addition, many dispensing closures are fastened to their associated package by threads. Threads require torquing type capping equipment which, on occasion, results in packages with non-oriented closures. Although such a filled tube may, from a technical standpoint, operate substantially as efficiently as one having the desired dead center alignment, as a practical matter the consumer tends to avoid purchasing such an out of alignment product, often on the assumption that there is something "wrong" with the product. In addition, torque type capping equipment is more costly than other types of capping equipment such as snap-on type capping equipment. Even the molds for screw-on type closures are more expensive than, for example, snap-on closures since screw-on molds usually require an unscrewing core or a collapsible core and, in general, are more complex and expensive than snap-on closure molds.

A further drawback with many current closures is that such closures almost invariably have a protruding tab in order to enable a user to quickly and conveniently locate the "handle" formed by the tab for easy opening and closing of the product. When a protruding tab extends outwardly beyond the outer diameter of the base of the closure, interference in the capping process and in the automatic handling of the closure can occur.

Raised orifice spouts are an advantage to the consumer because of their distance from the conventional deck of the closure. An orifice flush with the deck of the closure can be harder to clean than a raised orifice, and a raised orifice spout gives the consumer a greater angled view to the orifice than a flush orifice. Thus a dispensing closure which will accommodate raised orifices of substantial heights is a distinct advantage over a package which includes a flush orifice. In addition, a raised spout also makes possible the application of a foil "freshness" seal applied to the top of the spout. Such a seal provides a measure of tamper resistancy, as well as retaining the integrity of seal of the package and thus the freshness (moisture and oxygen barrier) of the product.

And finally, all, or nearly all, conventional closures include, as a necessary feature, a closure deck. Such a deck requires a substantial quantity of material which, since most such closures are manufactured from good quality resins, comprises a significant item of cost.

SUMMARY OF THE INVENTION

The invention includes (i) a concealed hinge dispensing closure which can be molded in a closed position, (ii) a tamper resistancy feature which is added in the molding process, (iii) has a lid with a lifting and closing tab which does not extend beyond the periphery of the closure, (iv) is assembleable to a dispensing container by a snap-on process, (v) is of any desired height so as to be usable with a container having a dispensing spout of substantial height, and (vi) does not require a closure deck. As a consequence, the molding costs of the closure are lower than conventional closures because a mold can contain twice as many closure cavities as a molded open closure mold, and the cycle time is less. Safety tabs can be formed during the molding process thereby eliminating later, and more costly, applications of shrink wraps and cardboard, with a consequent decrease in excess packaging which must be thrown away upon initial use.

Further, the closure, due to a uniform periphery wherein neither hinges or open-close tabs protrude beyond the periphery, is well adapted to be used in automatic assembly and handling equipment, and, since the closure may be snapped onto an associated container, the less costly snap-on type capping equipment can be used.

A distinct advantage over many conventional closure systems is that the present design permits the deck and spout of the conventional closure to be transferred, in effect, to the tube head thus greatly simplifying the design of the closure and reducing its cost, possibly without a significant increase in the cost of the tube. And since the closure does not contain a closure deck, less material is required in the closure than in similar type closures. Even though no closure deck is used, the closure can be of substantial height so that the container can include a raised orifice spout of any desired height.

BRIEF DESCRIPTION OF THE DRAWING

The invention is illustrated, more or less diagrammatically, in the accompanying drawing in which.

DESCRIPTION OF SPECIFIC EMBODIMENT

Figures 1, 2, 3, 4, 5:
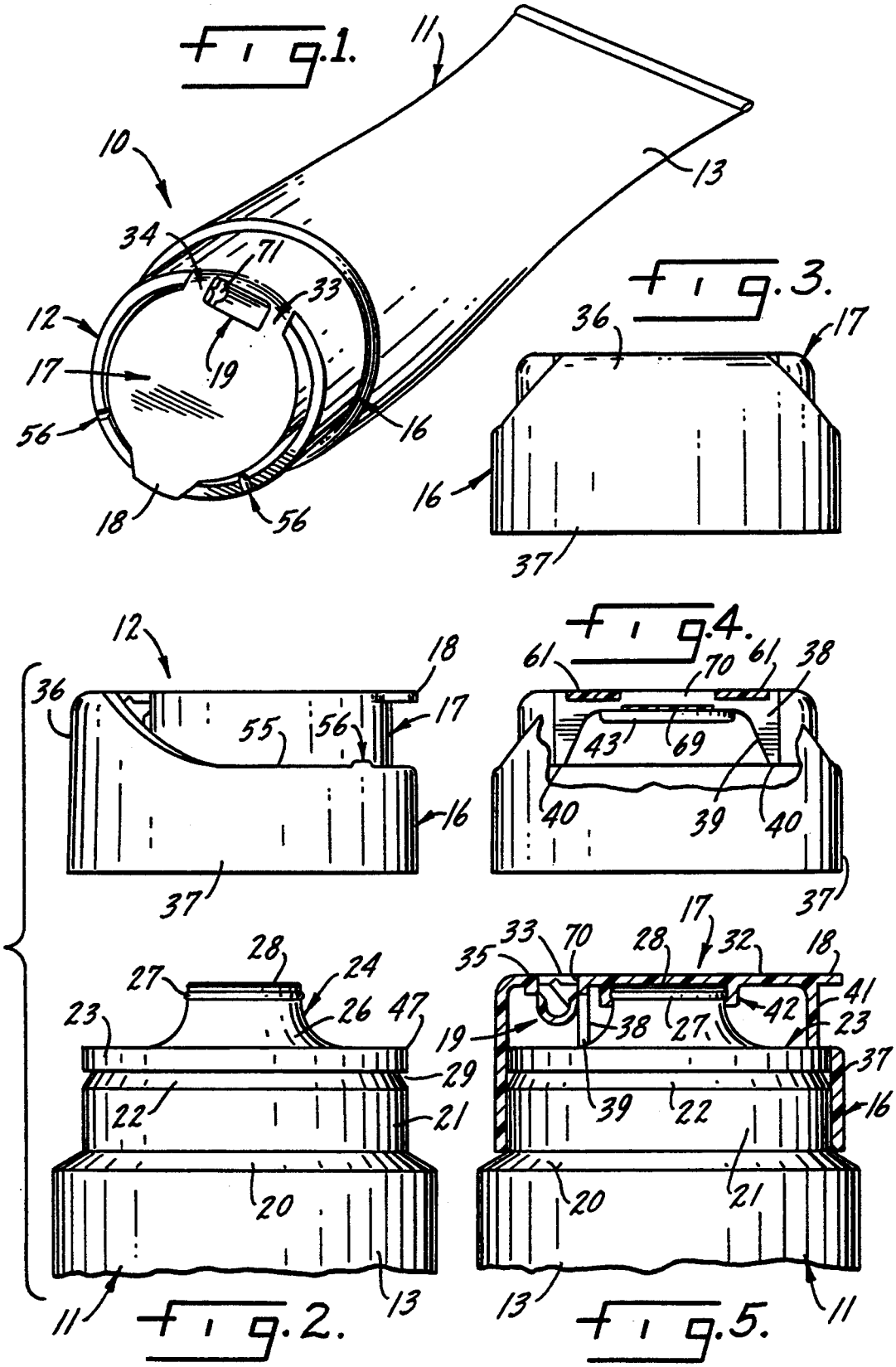
FIG. 1 is a perspective view of a dispensing package, using a tube for illustration, in which the unique dispensing closure assembly of this invention has been incorporated.
FIG. 2 is an exploded elevation of the top end portion of a typical container assembly with which the dispensing closure assembly of this invention is intended to be used, and the dispensing closure assembly of this invention.
FIG. 3 is a rear view of the closure assembly of this invention.
FIG. 4 is a similar rear view with portions broken away.
FIG. 5 is a side view in partial section of the dispensing closure assembly of this invention assembled to a tube.

Like reference numerals will be used to refer to like or similar parts from Figure to Figure in the following description of the drawing.

Referring to FIG. 1 a package is indicated at 10, the package consisting of a container assembly, indicated generally at 11, and a closure assembly, indicated generally at 12. It will be understood that the product contained within the container assembly 11 may vary widely from automotive grease to medicinal ointments. For convenience of description, it will be assumed that a typical consumer product, such as toothpaste, is the product to be stored and dispensed at the will of a user. It should be understood, however, that reference to toothpaste is for convenience only and is not to be taken as limiting the scope of the invention. The container assembly 11 includes, in this instance, a tube structure 13 which is closed at one end, as by crimping. The closure assembly 12 includes a closure base, indicated generally at 16, and a closure lid, indicated generally at 17. A lift tab, which is part of the closure lid, is indicated at 18, and a hinge assembly which connects the lid to the base is indicated at 19.

Referring now to FIG. 2 the closure assembly 12 is shown exploded away from the container assembly 11. The tube structure 13 includes an inwardly and upwardly inclined lower transition section 20, a top section 21 whose outer diameter is sized to be received within the closure base 16 as will be described in detail hereinafter, an upper inwardly and upwardly inclined transition section 22, and a tube deck 23 from which a pouring or dispensing spout structure, indicated generally at 24, extends upwardly. The top section 21, transition section 22 and tube deck 23 are all known as the "neck finish" and that term will be used from time-to-time hereinafter. The spout structure includes a neck portion 26 which has an eye-pleasing upwardly curved contour, a peripheral bead 27 and, in this instance, a conventional foil safety seal 28. It will be noted that the tube deck 23 side walls overhang the upper surface of the upper transition section 22 to form an annular indentation 29 or indent ring for a purpose which will appear hereinafter.

Referring now to FIG. 5 the relationship of the closure assembly 12 to the container assembly 11, and specifically the upper end portion of the container assembly 11, is illustrated in greater detail.

Figure 6:
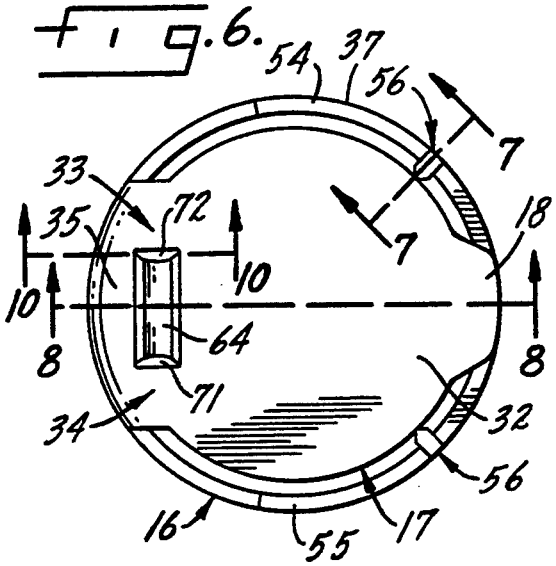
FIG. 6 is a top plan view of the dispensing closure assembly of this invention.

The closure lid 17 includes a central, generally circular top plate 32 (see also FIG. 6) which moves from the closed position of FIGS. 5 and 6 to the fully opened position of FIG. 15, as will be described hereinafter. The lift tab 18 is integral with top plate 32. The top plate 32 is connected by the hinge assembly 19, which includes hinge plates 33, 34, see FIG. 6 also, to hinge base 35 which in turn is an integral horizontal extension of a vertical extension 36 from the enclosed circular base wall 37, see also FIGS. 3, 4, 6 and 8. The lid and hinge base form a top disposed on the closure base. A reinforcement wall 38 located forwardly of hinge assembly 19 projects downwardly from top plate 32. Wall 38 is cut away as at 39, see FIG. 4, 5, and 8–10, so as not to interfere with spout structure 24. A lid skirt, which extends approximately 300° about the circumference of the top plate 32 is indicated at 41, see FIGS. 5,7,8, and 12. As will be best seen from FIG. 3, the closure base 16 conceals the hinge means from view from the hinge side of the closure base.

Figure 11:
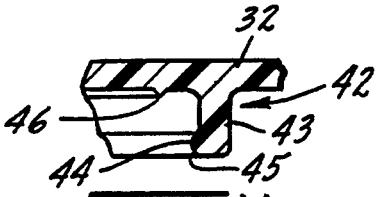
FIG. 11 is a detail view of the fastener portion of the dispensing closure.
Figure 13:
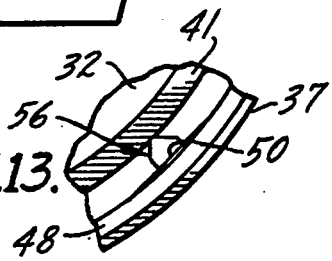
FIG. 13 is a detail view to an enlarged scale of the gripper means for maintaining the base of the closure to the tube/bottle neck finish and additionally a view of the tamper resistant cover and base of the dispensing closure assembly in spaced, tamper resistancy position with respect to one another prior to the first use by a user.

Fastener means for ensuring that the closure lid 17 remains secured to the tube spout 24 is indicated generally at 42 in FIGS. 5 and 11. The fastener means includes a downwardly projecting circular flange 43 which has an internal bead 44 encircling its lower, inner end. The bead 44 has a curved contour 45 on its lower side so that it will easily cam past the peripheral bead 27 on the spout structure 24 and engage the underside of bead 27 to secure the closure lid to the spout structure 24. A circular downwardly pointed seal ring 46 engages the exposed upper rim surface of the neck portion 26 of the spout after the safety seal 28 has been removed to seal the contents of the tube assembly from ambient atmosphere after the first use by the user, and the removal of the foil seal 28.

Figure 15:
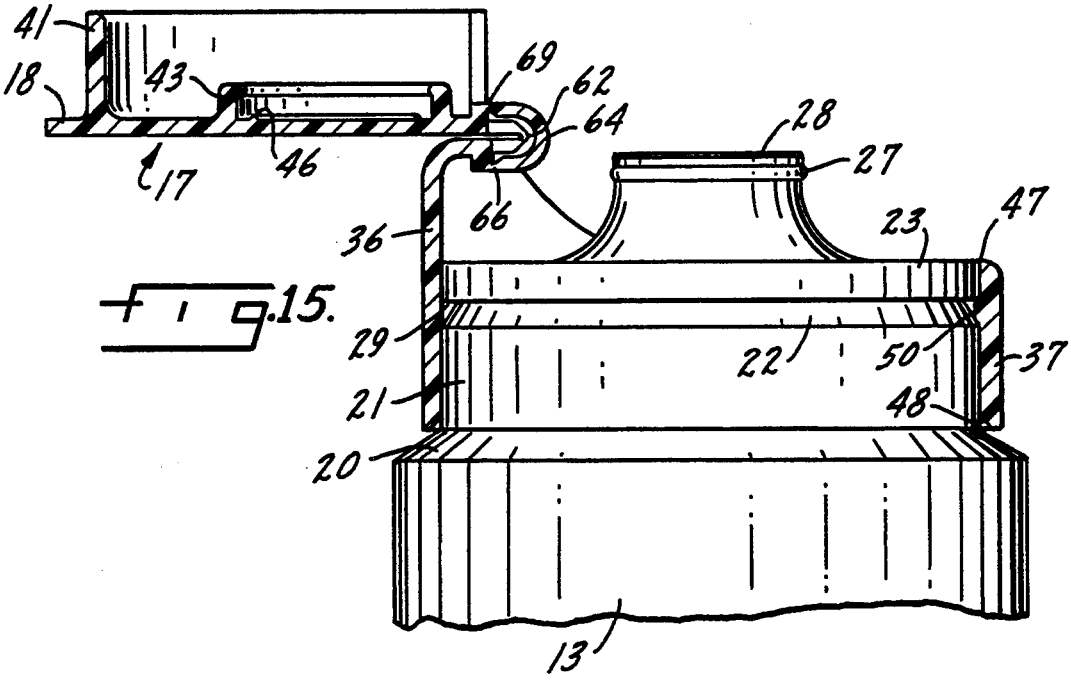
FIG. 15 is a view similar to FIG. 14 but showing the closure in a fully open, or 180°, position.

The means for securing the closure assembly 12 to the container assembly 11 is illustrated best in FIGS. 2, 5, 7, 8, 10 and 15. Referring first to FIG. 15, the inner edge of the base wall 37 is chamfered as at 48 so that when the container assembly 11 and the closure assembly 12 are brought into engagement for securement to one and other, the base wall 37 will contact the upper outer edge 47, see FIG. 2, of the tube deck 23 as the closure assembly moves to its fully engaged position of FIGS. 5 and 15.

Figure 7:
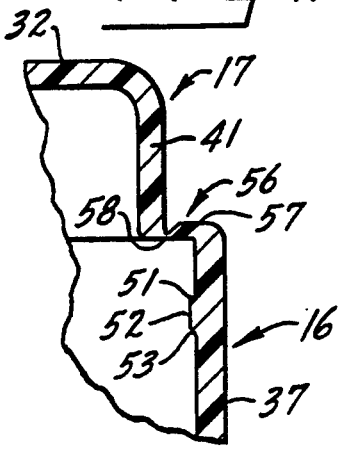
FIG. 7 is a partial section view taken substantially along the line 7—7 of FIG. 6 but to a larger scale than shown in FIG. 6.
Figure 8:
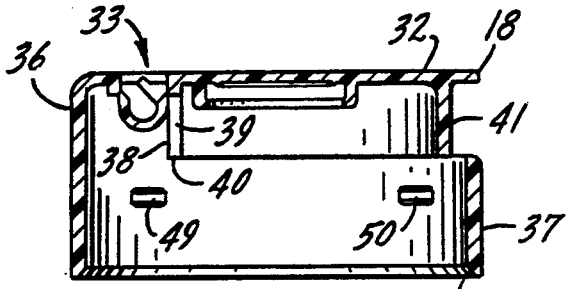
FIG. 8 is a section view taken substantially along the line 8—8 of FIG. 6 and showing the closure assembly in a fully closed position.

Referring now to FIGS. 5, 7, 8 and 10, and to FIG. 8 initially, two of four snap-on lugs are indicated at 49, 50. For purposes of illustration a lug is indicated in FIG. 15 on the right side of the package. Each lug consists of an upper inclined surface 51, see FIG. 7, which could be flat but, as shown, is preferably inclined slightly downwardly and inwardly, a vertical surface 52, and a lower downwardly and outwardly inclined surface 53, the three surfaces forming a projection which is snugly received in the area 29 whose cross section is generally triangularly shaped as shown in FIGS. 5 and 15. It will be noted that the slant of the lower surface 53 matches the slant of the transition section 22 of the container assembly 11, and the upper surface 51 fits slightly under the overhanging edge of the tube deck 23. The upper slanted surface 51 makes possible the removal of the closure assembly 12 from the container assembly 11 with the application of sufficient force exerted between the lower edge of base wall 37 and the lower transition section 20. If the contained product is tooth paste and hence there is little or no foreseeable need to disassemble the closure assembly from the container assembly during the normal life of the package, the upper surface 51 could be flat, though mold design considerations could still indicate the use of the illustrated slanted configuration.

The unique means for molding the package in a closed position is illustrated best in FIGS. 6, 7, 12, 13 and 14.

Figure 14:
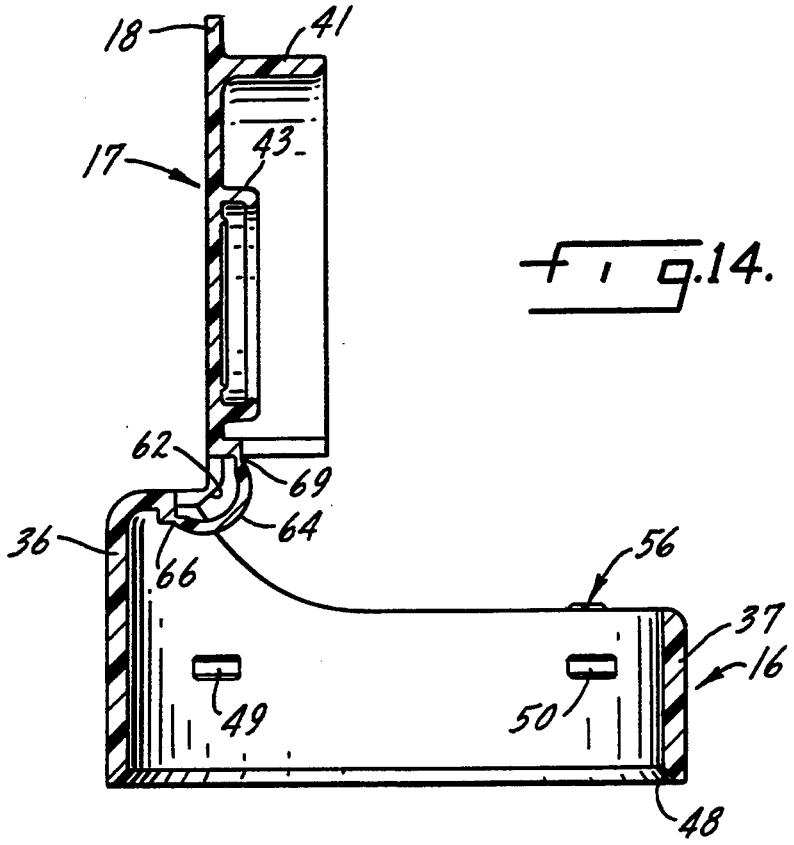
FIG. 14 is a side view partially in section showing the closure assembly in a partially opened position as it moves between fully opened and fully closed positions.

Referring first to FIG. 7, a tamper resistant member which joins the closure lid 17 to the closure base 16 is indicated generally at 56. The tamper resistant feature is a tab which is formed integrally with base wall 37 as best seen in FIGS. 7 and 14. The tamper resistant tab includes a base section 57 which terminates in a thin strap 58 which joins the lower outer edge of lid skirt 41 to base wall 37. The strap 58 may, for example, be on the order of only about 0.006" in thickness and hence it forms a line of weakness which can be readily ruptured by the application of upwardly directed thumb pressure on lift tab 18, yet the tamper resistant tab, of which two are shown in this instance, are sufficiently strong to maintain the closure base 16 and the top plate 32 and its depending lid skirt 41 in the position of FIG. 7 during molding, including ejection, and subsequent handling and capping steps. It will be understood that since the top plate 32 is oriented relative to base wall 37 as shown in FIG. 6, engagement pressure for pushing the closure assembly 12 onto the container assembly 11 may be exerted on the upper exposed surface portions 54, 55 of base wall 37, see FIG. 6 and thus little pressure will be exerted on closure lid 17 which would be transmitted to the thin straps 58. As a result, the integrity of the straps 58 is maintained until the user, such as a consumer, prepares to use the package for the first time.

The unique concealed hinge feature of this invention is illustrated best in FIGS. 1, 5, 6, 8–10, 12, 14 and 15.

Figure 9:
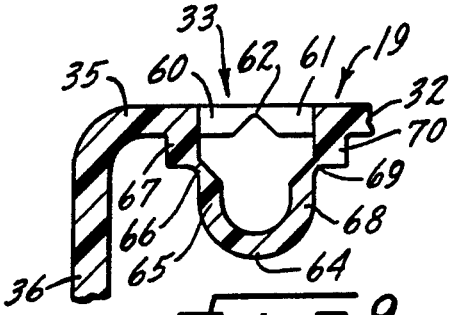
FIG. 9 is a detail view of the hinge section of FIG. 8 to a larger scale.
Figure 10:
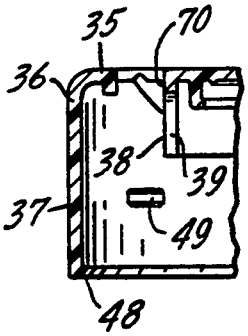
FIG. 10 is a view taken substantially along the line 10—10 of FIG. 6.
Figure 12:
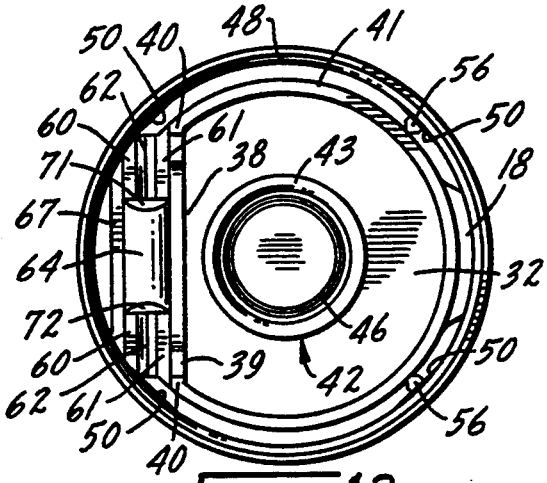
FIG. 12 is a bottom plan view of the dispensing closure assembly.

Referring first to FIG. 9, which is a detailed view of the hinge portion of FIG. 8, but to a larger scale, it will be seen that the upper surface of left hinge plate 33 is flush with the top surface of top plate 32 so that a smooth, aesthetically pleasing appearance is presented to the eye. Since hinge plates 33 and 34 are identical, only hinge plate 33 will be described. This can also be seen from FIGS. 1 and 6. The hinge plate 33 includes a rear portion 60 and a front portion 61, the two portions tapering upwardly at the mid-portion of the hinge plate to define a bend line area 62. It will be understood that the material to the left of bend line area 62 in FIGS. 6 and 8 is integral with, and forms a portion of, hinge base 35, and the material to the right of bend line area 62 is integral with, and forms a portion of, top plate 32.

The hinge assembly 19 includes a U-shaped hinge 64 whose rear leg 65 terminates in a thin strap 66 which in turn is integral with depending rear base member 67 which is integral with hinge base 35. The front leg 68 of hinge assembly 19 terminates in a thin strap 69 which in turn is integral with the depending front base member 70 which is integral with the top plate 32. The left end and right end portions of hinge 64 are preferably cut away as at 71, 72, see FIG. 6 and 9 to relieve any tendency for the hinge assembly to bind as it moves from a fully closed to a fully opened position, and back again.

The closure assembly 12 is illustrated in a fully closed position in FIGS. 5, 8, 9 and 12. This is the position in which the closure assembly is molded and snapped onto container assembly 11 prior to the first use of the package.

In FIGS. 14 and 15, the package has come into the hands of a consumer and it is shown in operation during the first use. In FIG. 14, the user has exerted upward pressure on lift tab 18, usually by a thumb or a finger, or both, and the thin straps 58 of FIG. 7 which held the closure lid 17 spaced from the closure base 16 have been broken so that there is no external restraint to movement of one with respect to the other. The lid 17 is shown in a 90° or half open position. In this position the hinge 64 has been flattened in contour and the hinge straps 66 and 69, as well as the hinge 64, are under considerable tension. By the same token, the material in the bend line area 62 has been partially extended. It will be understood, however, that since the material from which the closure assembly 12 is made is preferably a thermoplastic material such a polypropylene, and since the bend line area may be on the order of about 0.01" in thickness, the degree of deformation represented by the half open position of the FIG. 14 may be easily attained.

In FIG. 15, the closure 17 is in the 180° or fully opened position. In this condition the rear and front straps 66 and 69 of the hinge have had the tension represented by FIG. 14 relieved, and these straps are therefore under no tension. However, bend line area 62 is at maximum extension and tension but, as indicated in FIG. 15, the tension in bend line area 62 and straps 66 and 69 which tends to urge the closure 17 back to the position of FIG. 8 is insufficient to overcome the counterpressure of hinge 64 which tends to remain in its as molded position of FIG. 9. As a consequence, the closure 17 remains in a 180°, fully open position thereby providing maximum access, during use, to the spout 26.

It will be noted in FIGS. 5 and 15 that the container assembly 11 is shown in its condition as manufactured and up to the moment before the user seeks initial access to the contents of tube structure 13. In this position the foil safety seal 28 remains intact and hence the user can tell at a glance prior to first use whether the package 10 has been tampered with to the extent that the contents of tube structure 13 has been accessed. During the first use, the user will, of course, remove the foil safety seal 28 in any appropriate manner, such as by breaking with a finger and tearing around the periphery or lifting off by a suitable tab which is integral with the seal.

It will thus be seen that a unique closure assembly, and a closure assembly in combination with a container assembly to form a package, has been disclosed in which a smooth exterior periphery is provided, together with a concealed internal hinge which provides a smooth upper surface. At the same time, the closure assembly may be molded in a closed position thereby reducing dramatically the cost of production.

It will be understood that, although a specific embodiment has been illustrated and described, modifications and changes may be made within the spirit and scope of the invention. Accordingly, it is intended that the scope of the invention be limited solely by the hereafter appended claims, when interpreted in light of the relevant prior art, and not by the foregoing exemplary description.

We claim:

1. A closure assembly for a container assembly, said closure assembly including a stationary closure base, a movable lid, a stationary hinge base said hinge base and said closure base being structurally fixed with respect to one another in all relative positions of the lid to the hinge base and closure base, said lid and hinge base forming a top disposed on the closure base, said lid being pivotable about a bend line in the top, which bend line is located between the lid and the hinge base, hinge means located beneath the lid and hinge base for moving the lid into and out of engagement with the closure base, the closure base concealing the hinge means from the hinge side of the closure base, said hinge means including a hinge member which is connected, by film hinges, to the hinge base and the lid, said bend line being located between the film hinges, said hinge means being located within the outer peripheral surfaces of the closure base, the hinge base and the lid.

2. The closure assembly of claim 1 further characterized in that the hinge base and the lid are co-planar.

3. The closure assembly of claim 2 further characterized in that both film hinges are located beneath the top formed by the hinge base and the lid.

4. The closure assembly of claim 1 further including means for lifting the lid away from the closure base by finger applied pressure, that portion of the lifting means effective to lift the lid from the closure base being located within the periphery of the closure base.

5. The closure assembly of claim 4 further characterized in that the entire lifting means is located within the outer periphery of the closure base.

6. The closure assembly of claim 1 further characterized in that both film are located beneath the top formed by the hinge base and the lid.

7. The closure assembly of claim 6 further characterized in that the hinge means includes firstly, a generally curved member located beneath the upper surface of the lid and having its radially outermost end connected to a rigid portion of the closure assembly in an outer area of the lid and the closure base, and secondly, a line of weakness flanking the curved member and extending from the curved member outwardly to the periphery of the lid.

8. The closure assembly of claim 1 further including strap at least one connecting a lower portion of the lid to the upper portion of the closure base in an as-manufactured condition, said strap being rupturable by finger applied pressure preceding initial use of the closure assembly.

9. The closure assembly of claim 8 further-characterized in that the major portion of the periphery of the lid lies radially within the periphery of the closure base whereby the lid is isolated from vertically downwardly acting force applied to that portion of the closure base lying radially beyond the lid during connection of the closure assembly to the container assembly.

10. The closure assembly of claim 1 further including means carried by the closure base for locking the closure assembly to the container assembly.

11. The closure assembly of claim 10 further characterized in that the locking means are projection means extending inwardly from the interior of the closure base at a location which enables said projection means to be received in an indent ring formed in a container neck finish with which the closure assembly is to be associated.

12. A package, said package including a container assembly and a closure assembly, said closure assembly including a stationary closure base, a movable lid, a stationary hinge base, said lid and hinge base forming a top disposed on the closure base, said lid being pivotable about a bend line in the top, which bend line is located between the lid and the hinge base, hinge means located beneath the lid and hinge base for moving the lid into and out of engagement with the closure base, the closure base concealing the hinge means from the hinge side of the closure base, said hinge means including a hinge member whose opposite ends are connected, by film hinges, to the hinge base and the lid, said bend line being located between the film hinges, said hinge means being located within the outer peripheral surfaces of the closure base, the hinge base and the lid, said container assembly including a container having a dispensing spout at the upper end portion thereof and, a deck located at the upper end portion of the container, said deck being received within the lower portion of the closure base.

13. The package of claim 12 further including locking means for locking the closure assembly to the container assembly.

14. The package of claim 13 further characterized in that the locking means are projection means extending inwardly from the interior of the closure base means at a location which enables said projection means to be received in an indentation ring formed beneath the container deck.

15. A molded closed closure assembly, said molded closed closure assembly including a closure base consisting of a generally vertically disposed wall, said closure base having an unobstructed interior, a movable lid, a hinge base, said hinge base and said closure base being structurally fixed with respect to one another in all relative positions of the lid to the hinge base and closure base, said lid and hinge base forming a top overlying the closure base, said lid being pivotable about a bend line in the top, which bend line is located between the lid and the hinge base, hinge means located beneath the lid and hinge base, the closure base concealing the hinge means from the hinge side of the closure base, said hinge means including a hinge member whose opposite ends are connected, by film hinges, to the hinge base and the lid, said bend line being located between the film hinges, said hinge means being located within the outer peripheral surfaces of the closure base, the hinge base and the lid.

16. A closure assembly for a container assembly, said closure assembly including a closure base, a lid, a hinge base, said lid and hinge base forming a top disposed on the closure base, said lid being pivotable about a bend line in the top, which bend line is located between the lid and hinge base, hinge means located beneath the lid and hinge base for moving the lid into and out of engagement with the closure base, said hinge means including a hinge member whose opposite end are connected, by film hinges, to the hinge base and the lid, said bend line being located in a vertical plane between the film hinges, said hinge means being located within the outer peripheral surfaces of the closure base, and snap on means carried by the lid for snapping the lid onto the container assembly with which the closure assembly is to be associated, the snap on means being arranged to snap connect to a spout on an associated container assembly.

* * * * *